US006349440B1

(12) United States Patent
Amberg et al.

(10) Patent No.: US 6,349,440 B1
(45) Date of Patent: Feb. 26, 2002

(54) INDEPENDENT DOSING CONTROL SYSTEM FOR WASHING MACHINES

(75) Inventors: Guenther Amberg, Neuss; Hubert Kamml, Inzell, both of (DE)

(73) Assignee: Henkel Ecolab GmbH & Co., OHG, Dusseldorf (DE)

( * ) Notice: Subject to any disclaimer, the term of this patent is extended or adjusted under 35 U.S.C. 154(b) by 0 days.

(21) Appl. No.: 09/331,646

(22) PCT Filed: Dec. 15, 1997

(86) PCT No.: PCT/EP97/07039

§ 371 Date: Jun. 23, 1999

§ 102(e) Date: Jun. 23, 1999

(87) PCT Pub. No.: WO98/27858

PCT Pub. Date: Jul. 2, 1998

(30) Foreign Application Priority Data

Dec. 23, 1996 (DE) ..... 196 54 090

(51) Int. Cl.[7] ..... D06F 39/08

(52) U.S. Cl. ..... 8/158; 8/159; 68/17 R; 68/207; 222/651

(58) Field of Search ..... 68/17 R, 207; 8/159, 158; 134/100.1, 99.2; 222/57, 651

(56) References Cited

U.S. PATENT DOCUMENTS 2,254,269 A * 9/1941 Clark et al.
2,636,501 A * 4/1953 Hilliker
3,021,702 A * 2/1962 Houser
3,053,417 A * 9/1962 Box
3,307,744 A * 3/1967 Burford
3,557,811 A * 1/1971 Livingston
4,076,554 A * 2/1978 Weihe
4,932,227 A 6/1990 Hogrefe ..... 68/17 R
4,981,024 A * 1/1991 Beldham
5,207,080 A * 5/1993 Reinhard
5,246,026 A * 9/1993 Proudman
5,601,101 A * 2/1997 Grapes et al.
5,782,109 A * 7/1998 Spriggs et al.
5,826,749 A * 10/1998 Howland et al.
5,842,599 A * 12/1998 Douma et al.

FOREIGN PATENT DOCUMENTS

| | | |
|---|---|---|
| EP | 0 077 463 | 4/1983 |
| EP | 0 379 950 | 8/1990 |
| EP | 0 611 159 | 8/1994 |

* cited by examiner

*Primary Examiner*—Frankie L. Stinson
(74) *Attorney, Agent, or Firm*—Merchant & Gould P.C.

(57) ABSTRACT

The invention relates to a method for controlling the dosing of detergent in multiple stage washing machines having at least one separate detergent tank per washing stage. The entry of water into a detergent tank of the washing machine releases, without intervention in the washing control system, the single dosing of a predetermined amount of detergent into the detergent tank, the release of further dosages being prevented until a renewed activation. Furthermore, the invention relates to a control device for dosing detergents in washing machines in accordance with one of the above methods.

10 Claims, 2 Drawing Sheets

INDEPENDENT DOSING CONTROL SYSTEM FOR WASHING MACHINES

BACKGROUND OF THE INVENTION

This invention relates to methods for controlling the dosing of detergents in multistage washing machines comprising at least one dispensing compartment and to a control system for carrying out such methods.

DISCUSSION OF RELATED ART

Multistage washing machines or those operating on the multibath principle carry out at least two of the following stages: prewash, main wash, final wash, rinsing, softening, acidification, neutralization, disinfection, drying, and so forth. Some of these process stages require detergents or laundry aids which—in automatic washing machines—are automatically dispensed into the machine. This generally involves one dispensing compartment per stage, the control system of the washing machine ensuring that the water required to flush the detergent or laundry aid into the machine is delivered to the particular dispensing compartment.

Detergents or laundry aids can be formulated as powders, liquids or pastes. Automatic dosing systems for these products generally receive their control signals from the control system of the washing machine. This applies both to integrated systems and to separate systems whose connection generally entails modification of the washing machine controls. Such systems are complicated and—even if it takes all functions into consideration from the outset on an integrated basis—the hardware is very expensive.

Although the automation of the controls means that user-friendly systems are available at falling prices, the subsequent installation of dosing systems is complicated and expensive because of the necessary modification of the electronic washing machine control system.

SUMMARY OF THE INVENTION

The technical problem addressed by the present invention is to develop a dosing control system which works without any need for intervention in the washing machine control system and which enables detergents to be automatically dosed in a simple, uncomplicated manner. According to the invention, the solution to this problem is a method for controlling the dosing to detergents of. The entry of water into a dispensing compartment of the washing machine initiates the introduction of a single predetermined dose of detergent into that dispensing compartment without any need for intervention in the washing machine control system. The introduction of further doses remains blocked pending reactivation. A control system including a master sensor in at least one dispensing compartment of the washing machine without connection to the washing machine controls, is connected by a signal line to a dosing compartment and, whenever water enters such a dispensing compartment equipped with a moisture sensor, a signal is generated and internally processed in the dosing control system, for initiating the introduction of a predetermined dose of detergent into that dispensing compartment.

A dosing control system of this type has the advantage that it can be installed very easily without intervention in the washing machine or the dosing system. A moisture sensor merely has to be provided in those dispensing compartments for whose associated washing stage the automatic dosing of detergents or laundry aids is required. The signal generated by the sensor on the entry of flushing water is relayed to the dosing control system for the particular detergent. In order to ensure that a detergent is only dosed once per washing stage, the signal line is blocked after the first signal contact pending reactivation.

In one particular embodiment of the method according to the invention, which represents an extreme simplification, only the dosing system for the second stage of a two-stage washing process is automated, the dosing system for the first stage being manually initiated with the beginning of the washing process. This manual initiation also reactivates the introduction of a single dose for the second washing stage. In order to be able advantageously to adapt the individual demand situation of the particular washing process in a simple manner, at least a two-stage volume controller is used in another variant of the method according to the invention. A small/large volume can readily be selected for a two-stage process or a small/medium/large volume for a three-stage process, depending on the particular demand of the laundry being washed. In one simple advantageous embodiment, the volume controller is manually adjusted.

The control system according to the invention for the dosing of detergents is so simple and uncomplicated that it can be installed or even subsequently fitted using unskilled labor. The washing machine control system—unaffected by this installation—ensures that flushing water is introduced into the particular dispensing compartment before the next washing stage. When this flushing water wets the moisture sensor, the start signal is relayed to the dosing system and the particular detergent is introduced into the dispensing compartment with the wetted sensor. In the most simple case, the moisture sensor may consist of a single cable with two exposed terminals which generate a signal on wetting.

There is also no need for intervention in the dosing control system because only the start signal has to be delivered to the dosing system and the dosing control system present in any case then triggers the necessary measures. A preferred embodiment provides a device which ensures that only one dosing operation per washing stage is initiated during a cycle of the washing machine. Otherwise, dosing could be reactivated in a situation where the flushing water is introduced into the dispensing compartment for longer than the time for which detergent has to be dosed. The subject device may advantageously consist of an activator which is designed to be connected to the signal line before the dosing system and which, after the first signal, interrupts the line and can only be reactivated after the start of a new machine cycle.

A volume controller, for example with the settings small/large or small/medium/large, may also be designed as a separate module together with the signal line. This volume controller is connected by the signal line to the dosing control system and can ensure the delivery of a correspondingly predetermined quantity.

BRIEF DESCRIPTION OF THE DRAWINGS

The advantages described in the foregoing and other advantages will become clear from the following description of an embodiment of the invention which is illustrated in the accompanying drawings, in which like items have the same reference designation, wherein.

Although various embodiments of the invention have been shown and described, they are not meant to be limiting. Those of skill in the art may recognize certain modifications to those embodiments, which modifications are meant to be covered by the spirit and scope of the appended claims.

Figure 1:
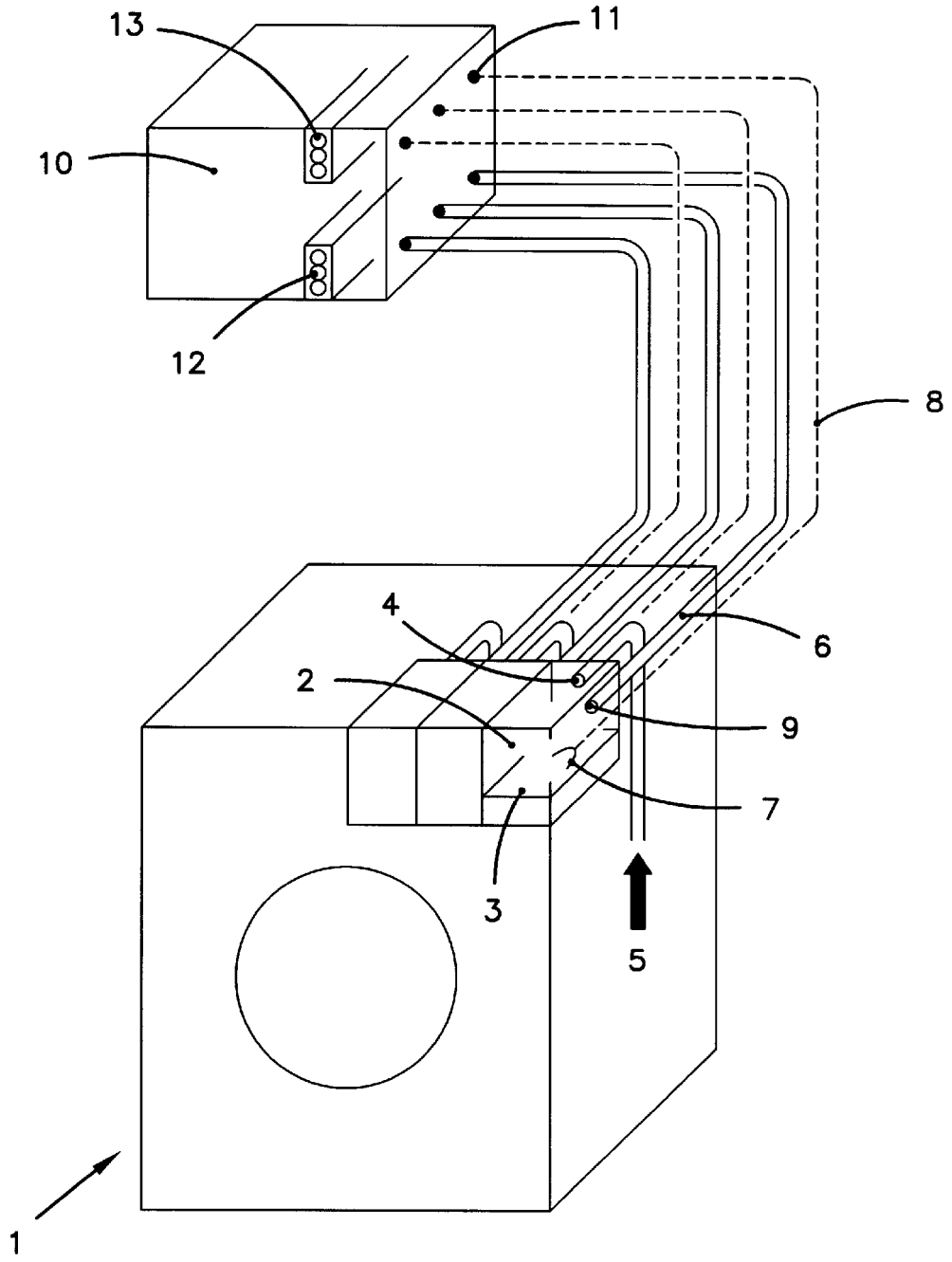
FIG. 1 schematically illustrates the connection of dispensing compartments of a washing machine to a separate dosing system.

FIG. 1 schematically illustrates a washing machine 1 in which three dispensing compartments 2 for detergents or laundry aids are arranged at the top right-hand front comer. The flushing water 5 is introduced through the nozzle 4 under the control of the washing machine control system. The flushing water 5 wets the moisture sensor 7 which relays a corresponding signal through the signal line 8 to the signal input 11 of the dosing system 10. Associated with the signal input 11 is an activator 13 which, after the first signal per wash cycle, interrupts the signal line and is only reactivated with the beginning of a new machine cycle.

The dosing system 10 controls the delivery of a corresponding dose of detergent through a dosing line 6 to the dose outlet 9 in the dispensing compartment 2. This dose can be determined in advance by a volume controller 12. The detergent enters the dispensing compartment 2 and is flushed by the flushing water 5 coming from the nozzle 4 into the funnel 3 and from there into the washing or treatment drum.

The volume controller 12 and activator 13 shown inside the dosing system 10 in FIG. 1 may also be separately connected before the dosing system 10 if these functions were not present from the outset in the dosing system 10.

Figure 2:
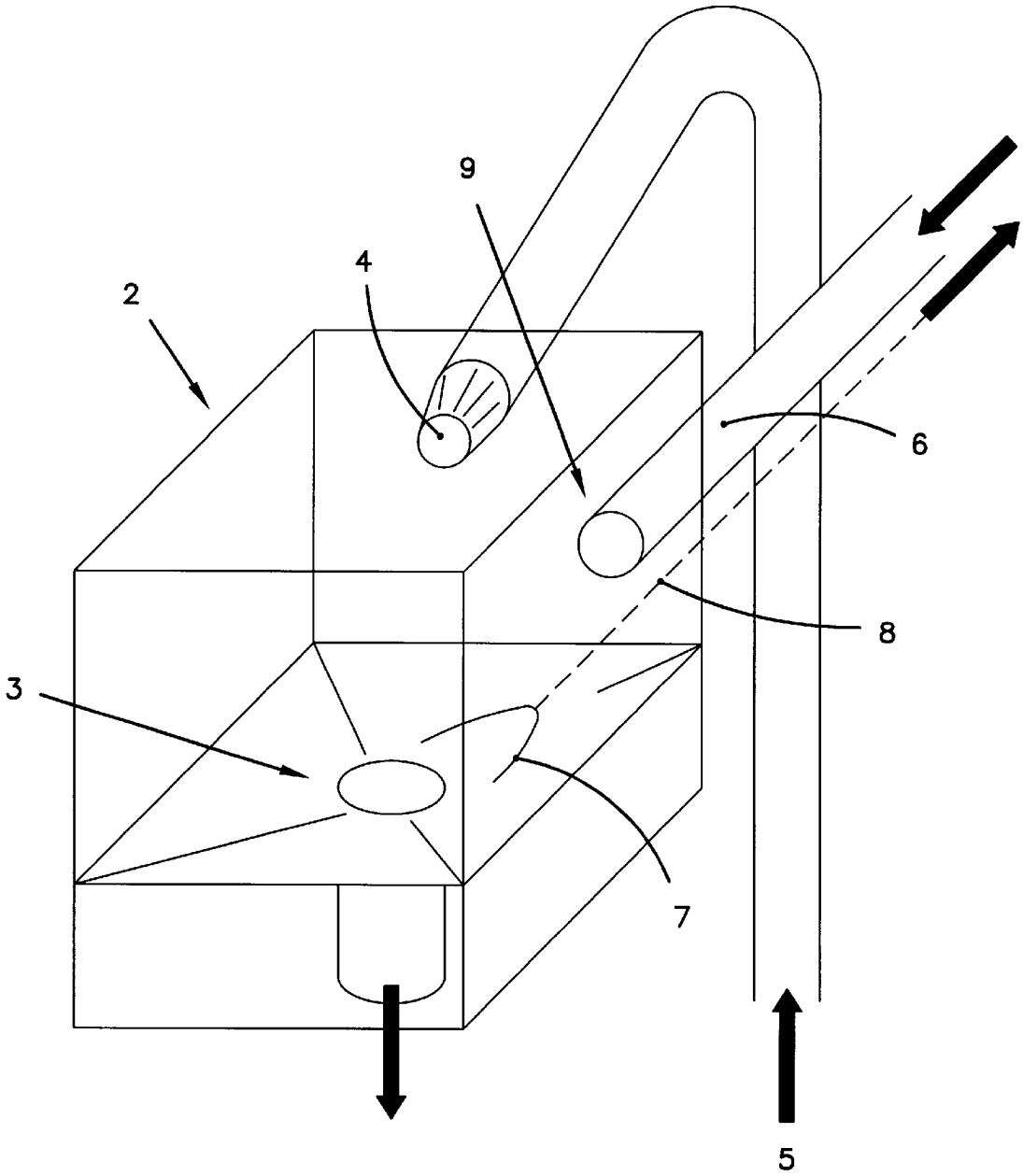
FIG. 2 is a detailed schematic view of a dispensing compartment.

The systematic arrangement of a dispensing compartment 2 shown in detail in FIG. 2 can be achieved in various ways. However, it must provide for the basic functions described above. Thus, where several dispensing compartments 2 are present, individual dosing lines 6 may run between the connection of the dosing compartment and the dose outlet 9, as shown in the drawing. However, the individual connections may also be made through so-called manifolds and a common line positioned in between. The flow directions for signals and media are indicated by arrows in the feed line for the flushing water 5, the signal line 8 and the dosing line 6 and in the pipe disposed below the funnel 3.

What is claimed is:

1. A method for controlling a dosing of detergents in multistage washing machines comprising at least one dispensing compartment, said method having steps including the entry of water into a dispensing compartment of the washing machine initiating the introduction of a single predetermined dose of detergent into that dispensing compartment without any need for intervention in the washing machine control system, wherein the predetermined dose of detergent is introduced into the dispensing compartment and the introduction of further doses is blocked pending reactivation.

2. A method as claimed in claim 1, wherein in a two-stage washing process, said method further includes the steps of the dosing of detergent for the first stage being manually initiated with the beginning of the washing process, and the dosing of detergent for the second stage being initiated by the entry of a water into the dispensing compartment for the second stage, whereby a manual start initiates reactivation.

3. A method as claimed in claim 2, wherein the amount of detergent to be introduced per washing stage is predetermined by at least a two-stage volume controller.

4. A method as claimed in claim 1, wherein the amount of detergent to be introduced per washing stage is predetermined by at least a two-stage volume controller.

5. A method as claimed in claim 4, wherein the volume controller is manually adjusted.

6. A control system for dosing detergents in washing machines comprising:

a moisture sensor being provided in at least one dispensing compartment of the washing machine and, without connection to the washing machine controls, being connected by a signal line to a dosing system and, whenever water enters a dispensing compartment equipped with a moisture sensor, a signal being generated and internally processed in the dosing control system, initiating the introduction of a predetermined dose of detergent into that dispensing compartment wherein the dosing system is designed to introduce a predetermined dose of detergent into the dispensing compartment; and a device which only allows one dosing operation per washing stage during a cycle of the washing machine consisting of an activator for interrupting the signal line after the first signal.

7. A control system as claimed in claim 6, wherein said device consists of an activator for interrupting the signal line after the first signal which can only be reactivated with the beginning of a new washing machine cycle.

8. A control system as claimed in claim 7, further including at least a two-stage volume controller which predetermines the size of the detergent dose for a washing stage, the volume controller preferably being manually adjustable.

9. A control system as claimed in claim 6, further including at least a two-stage volume controller which predetermines the size of the detergent dose for a washing stage, the volume controller preferably being manually adjustable.

10. A control system as claimed in claim 6, further including at least a two-stage volume controller with predetermines the size of the detergent dose for a washing stage, the volume controller preferably being manually adjustable.

* * * * *